US006407514B1

(12) United States Patent
Glaser et al.

(10) Patent No.: US 6,407,514 B1
(45) Date of Patent: Jun. 18, 2002

(54) NON-SYNCHRONOUS CONTROL OF SELF-OSCILLATING RESONANT CONVERTERS

(75) Inventors: John Stanley Glaser, Niskayuna; Regan Andrew Zane, Scotia, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,395

(22) Filed: Mar. 29, 2001

(51) Int. Cl.[7] ..... H05B 37/02
(52) U.S. Cl. ..... 315/247; 315/224; 315/282
(58) Field of Search ..... 315/307, 291, 315/224, 225, 278–282, 209 R, 247

(56) References Cited

U.S. PATENT DOCUMENTS

| | | | | |
|---|---|---|---|---|
| 4,464,606 A | * | 8/1984 | Kane | 315/282 |
| 4,667,132 A | * | 5/1987 | Leale | 315/224 |
| 5,945,783 A | | 8/1999 | Schultz et al. | 315/224 |
| 5,965,985 A | | 10/1999 | Nerone | 315/209 R |

OTHER PUBLICATIONS

"Electrodeless Fluorescent Lamp Dimming System," L. Nerone, Serial No. 09/318,343 (GE docket LD 11157), filed May 25, 1999, allowed Aug. 29, 2000.

* cited by examiner

*Primary Examiner*—Don Wong
*Assistant Examiner*—Wilson Lee
(74) *Attorney, Agent, or Firm*—Jill M. Breedlove; Christian G. Cabou

(57) ABSTRACT

A self-oscillating switching power converter has a controllable reactance including an active device connected to a reactive element, wherein the effective reactance of the reactance and the active device is controlled such that the control waveform for the active device is binary digital and is not synchronized with the switching converter output frequency. The active device is turned completely on and off at a frequency that is substantially greater than the maximum frequency imposed on the output terminals of the active device. The effect is to vary the average resistance across the active device output terminals, and thus the effective output reactance, thereby providing converter output control, while maintaining the response speed of the converter.

8 Claims, 6 Drawing Sheets

NON-SYNCHRONOUS CONTROL OF SELF-OSCILLATING RESONANT CONVERTERS

FEDERAL RESEARCH STATEMENT

The U.S. Government may have certain rights in this invention pursuant to contract number DEFC2699FT40630 awarded by the U.S. Department of Energy.

BACKGROUND OF INVENTION

Self-oscillating resonant power converters, such as commonly used in compact fluorescent lamp ballasts, for example, typically operate by deriving a transistor switching waveform from one or more windings magnetically coupled to a resonant inductor. U.S. Pat. No. 5,965,985 of Nerone describes a circuit for such a ballast that allows control of the output to a load in order to provide lamp dimming capability. U.S. Pat. No. 5,965,985 describes the control of a self-oscillating ballast by effectively clamping the voltage excursion across an inductor. The effect is to control the reactance of the inductor clamp combination. A similar method of achieving such a result is to vary the effective reactance of a reactive element using a variable resistance coupled in series or parallel therewith. The variable resistance is typically implemented with an active element, e.g., a transistor, wherein the effective resistance across two terminals is a continuous function of the magnitude of the control signal. The applied control signal is also continuous and has a maximum frequency component that is substantially less than the switching frequency of the converter.

It is desirable to implement control circuitry, such as of a type described hereinabove, on an application specific integrated circuit (ASIC) in order to achieve low complexity and cost. It is furthermore desirable to implement as much of the control circuitry as possible in digital form. Unfortunately, the control method described hereinabove inherently requires an analog, continuous signal. Hence, a digital approach, when combined with the control method described hereinabove, requires a digital-to-analog converter to generate the control signal, adding to the complexity of the system. In addition, the analog approach may result in significant power dissipation in the control element, making it impractical to integrate on an ASIC chip. These latter drawbacks may be overcome using a switch control waveform synchronized to the converter power switching waveforms, as known in the art, but for a self-oscillating converter, this results in the requirement of a frequency tracking circuit, such as a zero-crossing detector or phase-locked loop. This requirement may substantially increase cost, complexity, and size of the system.

Accordingly, it is desirable to provide a control for a self-oscillating switching power converter using an active control device in a manner that does not require the control switch waveform to be synchronized with the converter switching frequency. It is furthermore desirable that such control device be operated in a digital manner, that is, with two operating states (on and of f and that the control input for the device also be digital. It is furthermore desirable that such a control avoid compromising the response speed of the converter, so that maximum performance may be obtained.

SUMMARY OF INVENTION

In accordance with exemplary embodiments of the present invention, a self-oscillating switching power converter has a controllable reactance comprising an active device connected in series or parallel with a reactive element, wherein the effective reactance of the controllable reactance and the active device is controlled such that the control waveform for the active device is binary digital and is not synchronized with the switching converter output frequency. Preferably, the active device is turned completely on and off at a frequency that is substantially greater than the maximum frequency imposed on the output terminals of the active device. The effect of such control is to vary the average resistance across the active device output terminals, and thus the effective output reactance, thereby providing converter output control, while maintaining the response speed of the converter.

DETAILED DESCRIPTION

Figure 1:
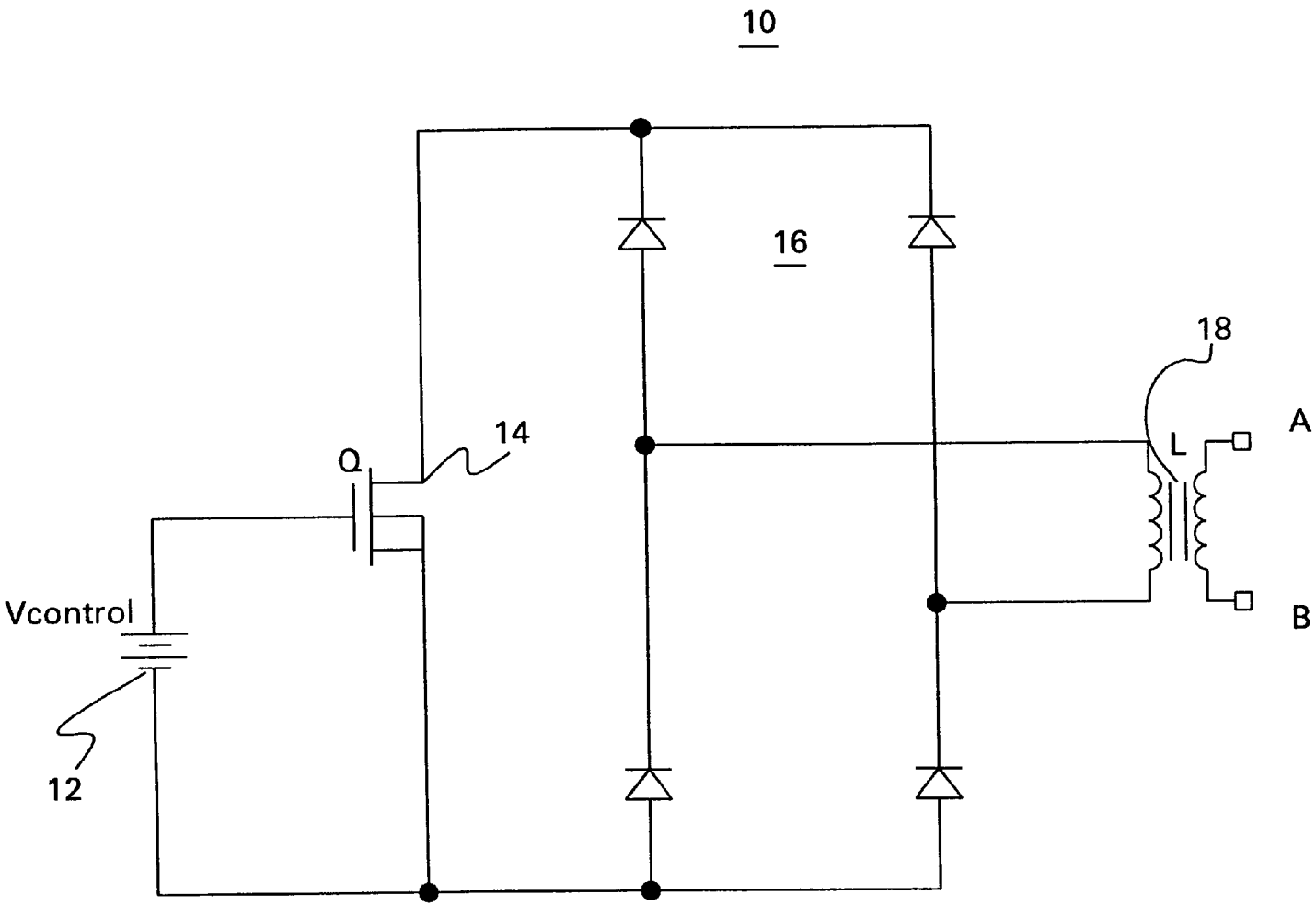
FIG.1 (PRIOR ART)
FIG. 1 schematically illustrates a control for a switching power converter of a type described by U.S. Pat. No. 5,965,985.

FIG. 1 illustrates a known implementation of a variable reactance control circuit 10 for a self-oscillating power converter. The control circuit comprises a dc control voltage 12 coupled to an active device 14. A diode bridge network 16 enables the typically unipolar active device 14 to function as a bipolar resistive element. In the circuit of FIG. 1, the controlled reactive element comprises an inductor 18. The effective resistance across terminals A and B of FIG. 1 is a continuous function of the magnitude of the control signal applied to device 14. The applied control signal is also continuous and has a maximum frequency component substantially less than the switching frequency of the converter. The variation in resistance across terminals A and B results in a varied effective inductance, the switching converter output being controlled thereby.

Disadvantageously, the circuit of FIG. 1 is not practicable for ASIC applications, such as, for example, a compact fluorescent lamp ballast, due to the complexity of adding a required digital-to-analog converter and also the difficulty of integrating a control device capable of dissipating sufficient power for such application on an ASIC chip. Moreover, the circuit of FIG. 1 is not capable of an all-digital ASIC implementation.

Figure 2:
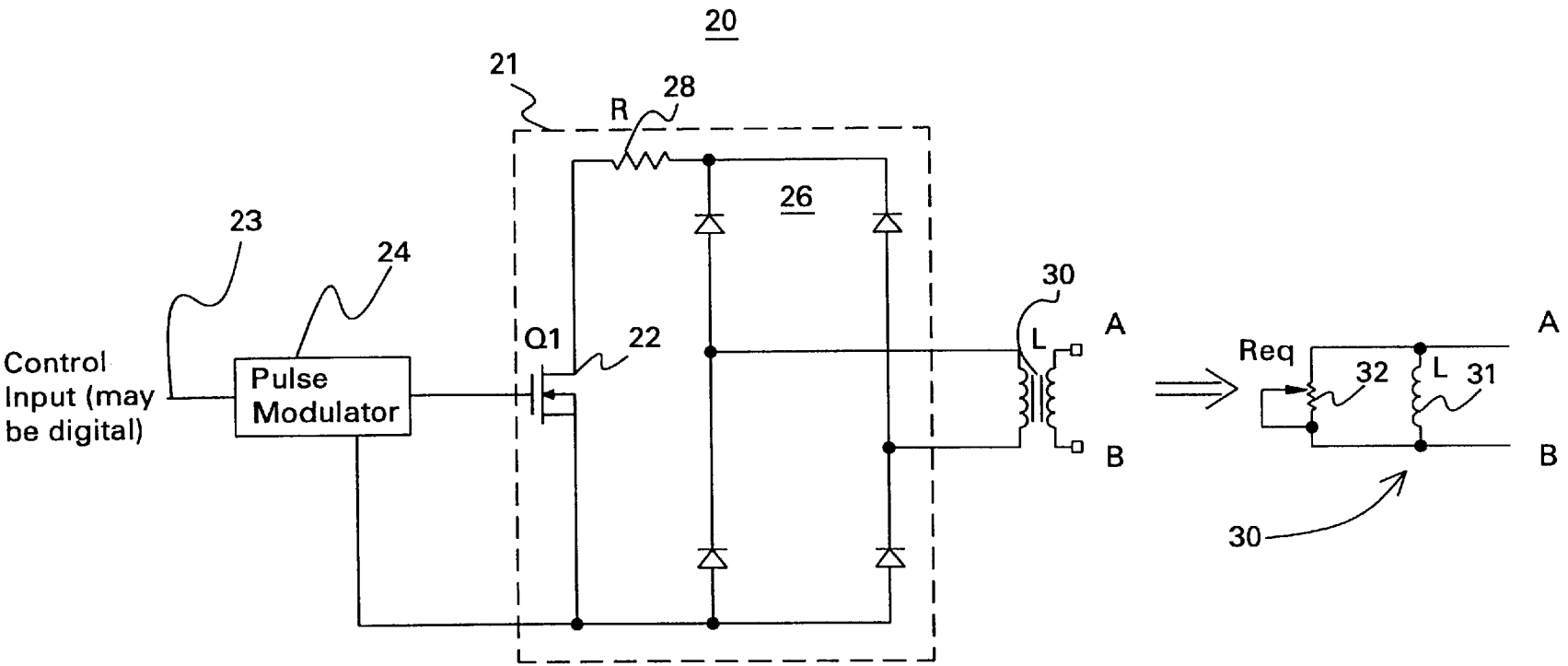
FIG. 2 schematically illustrates a control for a switching power converter in accordance with an exemplary embodiment of the present invention.

FIG. 2 illustrates a variable reactance control circuit 20 useful in a self-oscillating switching converter in accordance with exemplary embodiments of the present invention. Control circuit 20 comprises a bi-directional active device 21 having a pulse modulator 24 with a control input 23 thereto. A diode network 26 enables bi-directional operation to be achieved with a typically uni-directional active device 22. A resistor 28 (R) is coupled between switch 22 and the diode network 26. The reactance 30 to be controlled is illustrated in FIG. 2 as comprising an inductor 31.

Figure 3:
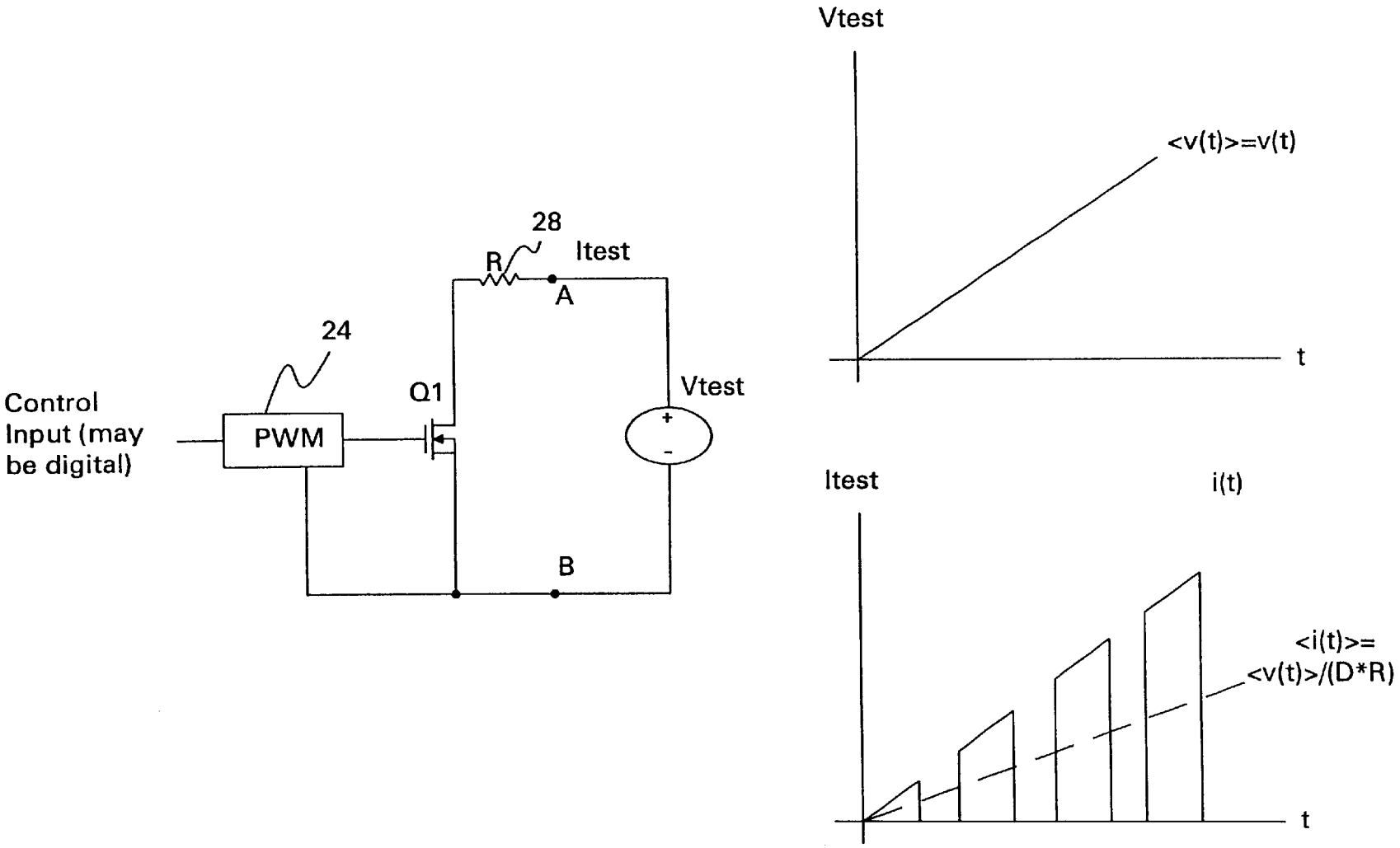
FIG. 3 schematically illustrates circuitry and graphs useful for describing operation of the circuit of FIG. 2.

In operation, the control frequency $F_C$ for device 22 is substantially greater than the maximum switching frequency $F_S$ imposed on terminals A and B. Typical values of $F_S$ might lie in the range of 10 kHz to 200 kHz, and a typical value for $F_C$ could be 1 MHz. In one embodiment, pulse modulator 24 provides a pulse width modulated (PWM) waveform with a duty cycle D. FIG. 3 illustrates PWM control and the effective resistance between terminals A and B, as represented by Vtest/Itest. The effect of the PWM waveform is to vary the average resistance in parallel with the inductance L between terminals A and B, wherein the average equivalent resistance 32 (Req) is given by Req =R/D, assuming that the value of resistance R is substantially greater than the on-resistance of switch 22. As a result, the effective resistance between terminals A and B is varied to provide the desirable control.

Advantageously, because the control frequency of switch 22 is substantially greater than the converter output frequency, the intrinsic bandwidth of the converter is not compromised. In particular, the control switch can respond to a change in input several times during each switching cycle, whereas the response of the switching converter is limited by the switching frequency and the even slower response of the reactive elements that form part of most switching converters. Thus, the control device is faster than the switching converter; hence, the bandwidth of the total system is limited by the switching converter. In addition, because no synchronization is required, circuit complexity is reduced. Another advantage is that more of the control ASIC is implementable in digital form, while reducing the analog portion. As a result, the converter is more robust, costs less, and has fewer ASIC support components. Still further, since the value R is substantially greater than the on-resistance of switch 22, most of the power dissipation occurs in R. The component R is preferably not on the ASIC, and the reduced dissipation in switch 22 enables integration of switch 22 on the ASIC. As yet another advantage, the effective resistance is substantially independent of active device parameters such that the effect is more consistent and predictable even with relatively large active device parameter variations.

Figure 4:
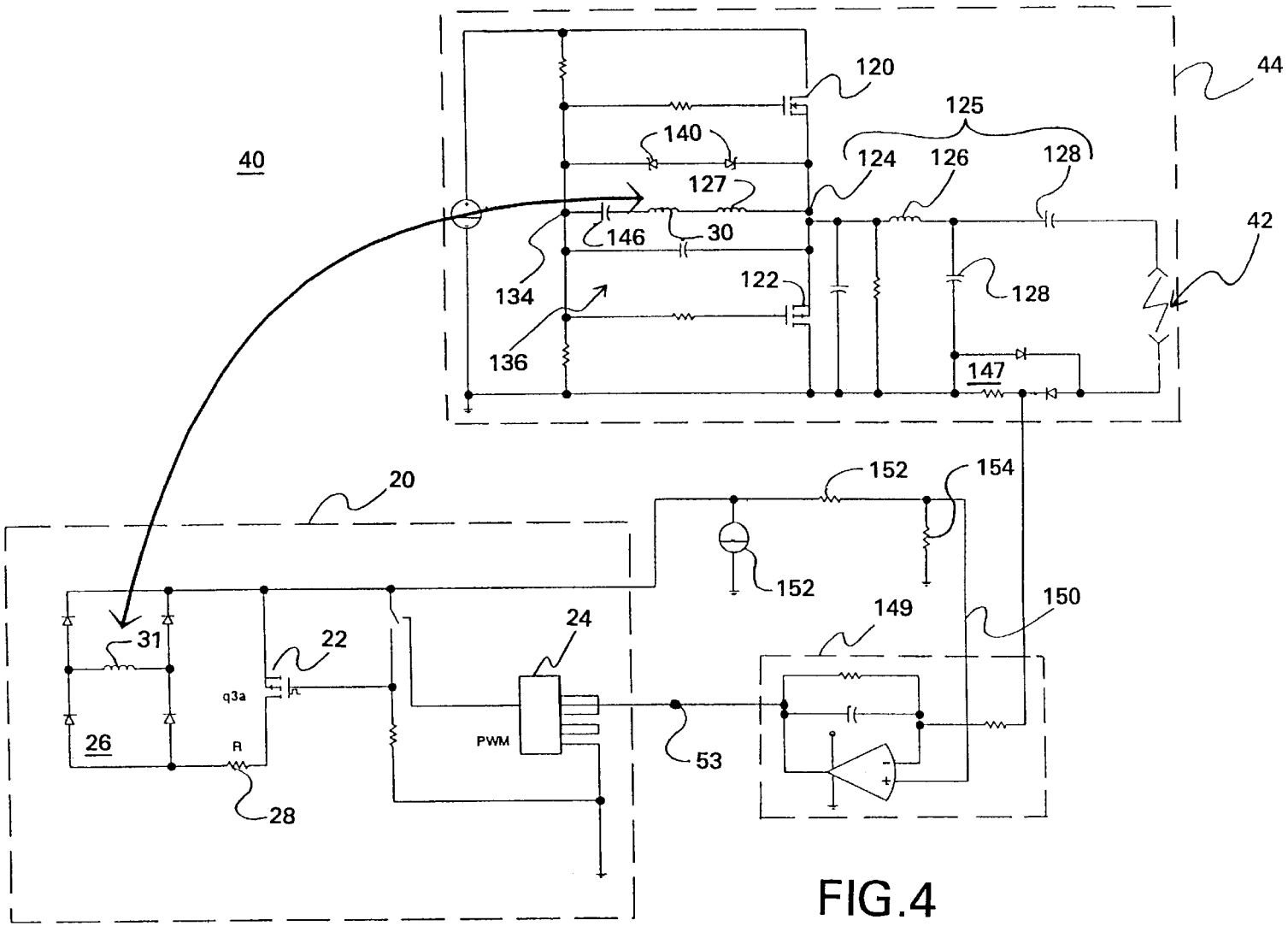
FIG. 4 schematically illustrates an exemplary application for a power converter and control of the present invention in a compact fluorescent lamp ballast.

An exemplary application for a variable reactance control in accordance with preferred embodiments of the present invention is in a dimmable compact fluorescent lamp (CFL) ballast. FIG. 4 schematically represents an exemplary CFL ballast 40 and lamp 42 system employing control circuit 20 (FIG. 2). in FIG. 4, block 44 represents a ballast and lamp system such as of a type described in U.S. Pat. No. 5,965,985, cited hereinabove. In the ballast, a converter comprises switches 120 and 122 that cooperate to provide ac current from a common node 124 to a resonant inductor 126. A resonant load circuit 125 includes resonant inductor 126 and resonant capacitor(s) 128 for setting the frequency of resonant operation. The gates of switches 120 and 122 are connected at a control node 134. Gate drive circuitry 136 is connected between the control node and the common node for implementing regenerative control of switches 120 and 122. A gate drive inductor 127 is mutually coupled to resonant inductor 126 in order to induce in inductor 127 a voltage proportional to the instantaneous rate of change of current in load circuit 125. A control inductance, comprising coupled windings 30 and 31, has inductance L controlled by control circuit 20 (FIG. 2). In particular, winding 30 is connected in series with gate drive inductor 127 between the control node and the common node. A bidirectional voltage clamp 140 connected between nodes 124 and 134, such as the illustrated back-to-back Zener diodes, cooperates with inductor 30 in such manner that the phase angle between the fundamental frequency component of voltage across resonant load circuit 125 and the ac current in resonant inductor 126 approaches zero during lamp ignition. A capacitor 146 may be connected in series with inductors 30 and 126, as shown. The lamp current is regulated by sensing the lamp current using current sensing circuitry 147 and comparing to a reference signal 150 via error amplifier circuitry 149. The output of the error amplifier is used to control the ballast in the manner described herein. In the exemplary dimmable ballast application, the reference signal 150 to the error amplifier 149 is provided, for example, via a dc power supply 152 and resistors 152 and 154 and may be adjusted in order to adjust the lamp current, which in turn adjusts the lumen output.

Figure 5:
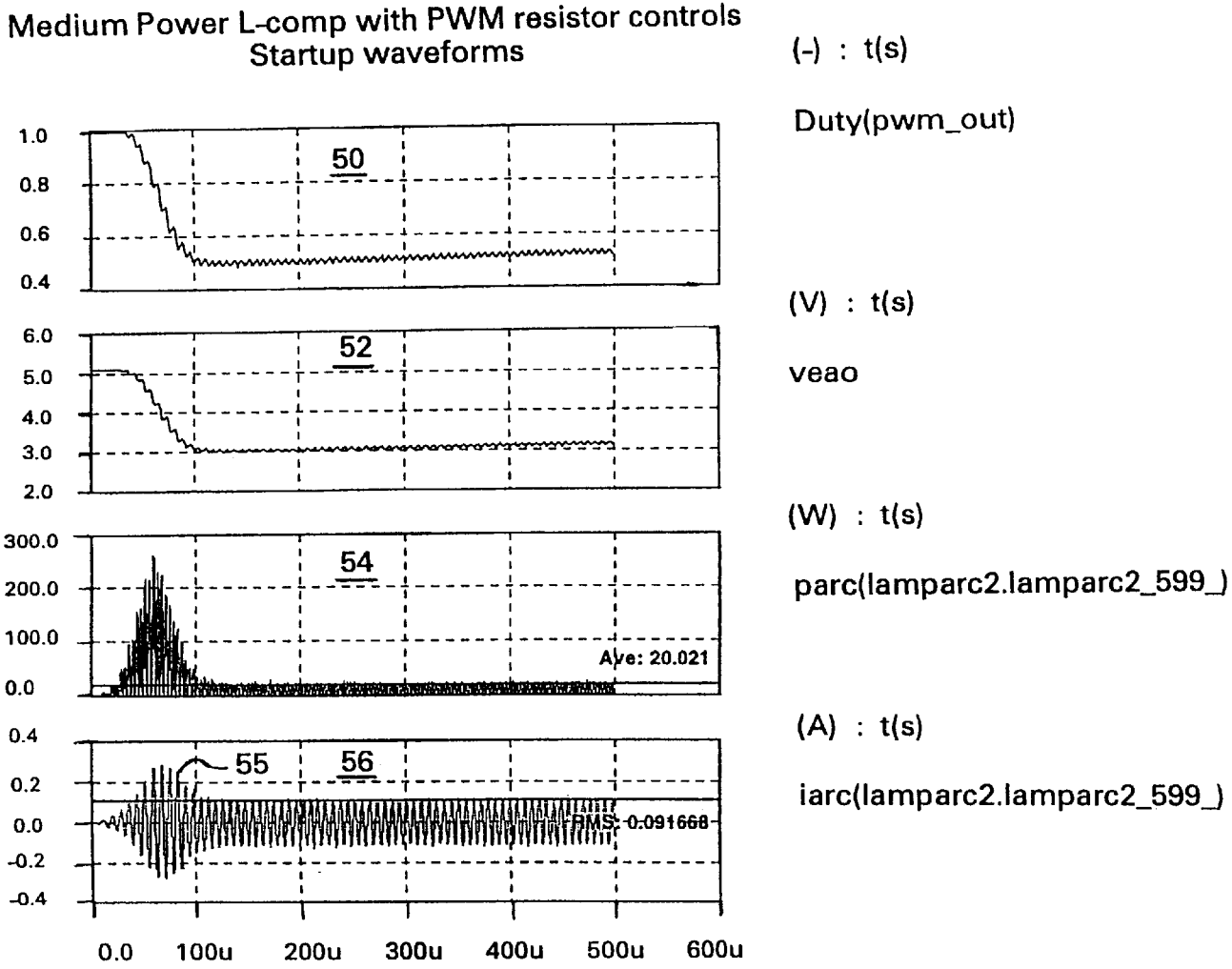
FIG. 5 graphically illustrates exemplary start-up and steady-state waveforms for the ballast of FIG. 4.

FIG. 5 graphically illustrates start-up and steady-state waveforms for the ballast of FIG. 4: Waveform 50 represents the duty cycle D; waveform 52 represents the input to the control circuit at point 53 in the circuit of FIG. 4; waveform 54 represents the lamp power; and waveform 56 represents the lamp current. As illustrated, after an initial transient 55, the control loop regulates the lamp current. Without the control loop, the ballast would be unstable, and the lamp arc would extinguish.

Figure 6:
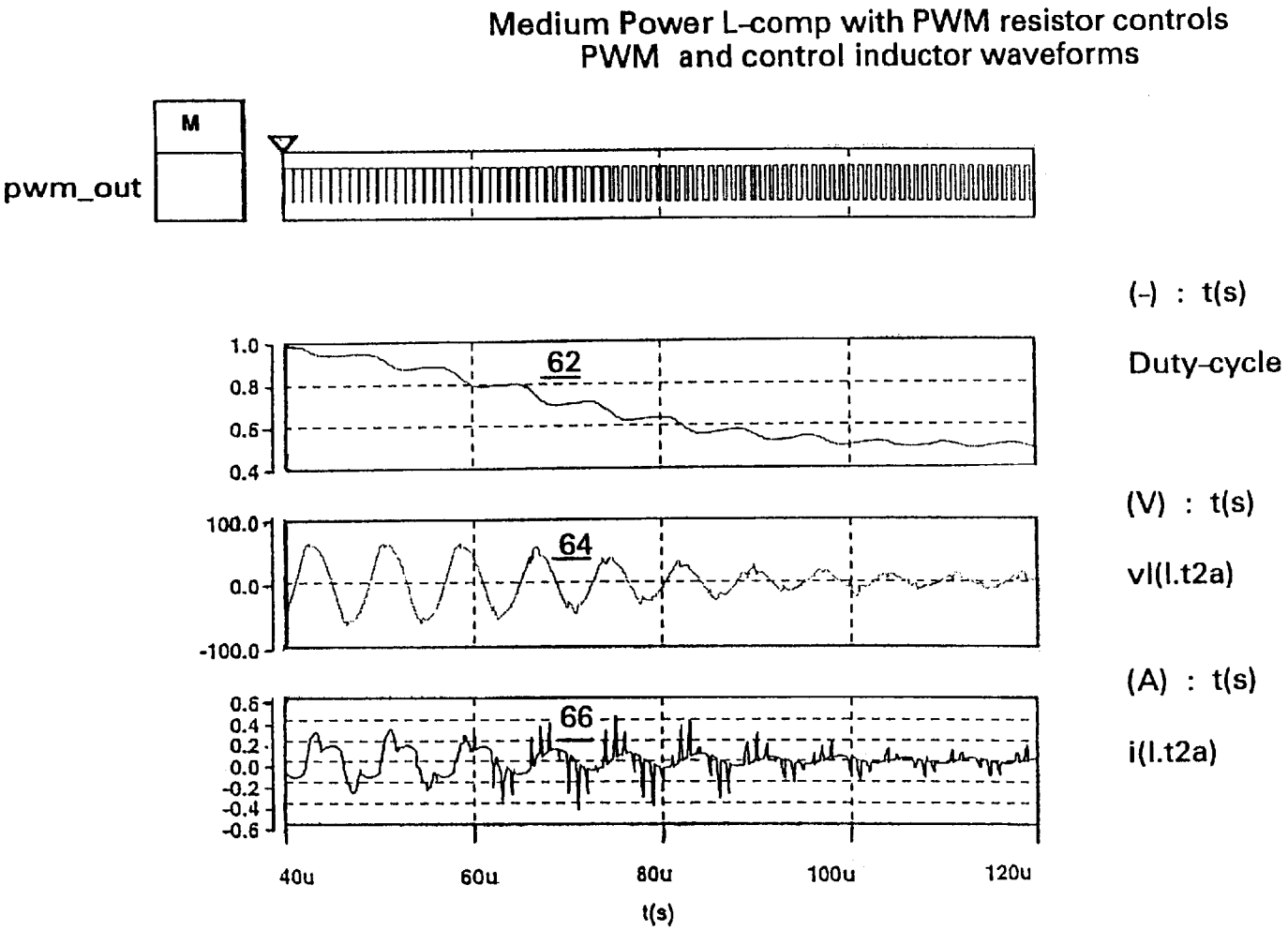
FIG. 6 graphically illustrates an exemplary transition from start-up to steady-state operation for the ballast of FIG. 4.

FIG. 6 graphically illustrates operation of the ballast of FIG. 4 when the in control loop begins to regulate the current. Waveform 60 represents the PWM signal to switch 22. Waveform 62 represents the duty cycle D. Waveform 64 represents the control inductor (winding 30) voltage, and waveform 66 represents the control inductor (winding 30) current. The pulsed current in the control inductor occurs when switch 22 is on. While the peak current is high, the average current is such that the equivalent average resistance is the same as the resistance produced by the original circuit of FIG. 1. The duty cycle changes as the control loop brings the lamp current into regulation.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A control circuit for a self-oscillating switching power converter, comprising:

a pulse modulator for receiving control signals from a control input and providing pulse modulated control signals therefrom;

a bi-directional active control device for receiving the modulated control signals from the pulse modulator;

a controlled reactance coupled to the active control device;

the pulse modulator turning on and off the active control device at a frequency greater than the maximum switching frequency of the converter in order to vary the effective resistance of the combination of the controlled reactance and the active control device such that the effective reactance thereof is controlled in accordance therewith.

2. The control circuit of claim 1 wherein the controlled reactance comprises a controlled inductor having at least one winding.

3. The control of claim 1 wherein the bi-directional active control device comprises a switching device coupled to a diode network.

4. The control of claim 1 wherein the pulse modulator comprises a pulse width modulator.

5. A dimmable self-oscillating ballast for a fluorescent lamp, comprising:

a resonant load circuit for coupling to the lamp, the resonant load circuit comprising a resonant inductor and a resonant capacitor;

a converter coupled to the resonant load circuit for inducing ac current therein, the converter comprising a pair of switching devices and connected at a common node;

gate drive circuitry for controlling the switching devices, the gate drive circuitry comprising a gate drive inductor coupled between the common node and a control node;

a converter control circuit comprising a pulse modulator for receiving control signals from a control input and providing pulse modulated control signals therefrom;

a bi-directional active control device for receiving the modulated control signals from the pulse modulator; and a controlled reactance coupled to the active control device;

the pulse modulator turning on and off the active control device at a frequency greater than the maximum output frequency of the converter in order to vary the effective resistance of the combination of the controlled reactance and the active control device such that the effective reactance at the output of the converter is controlled in accordance therewith.

6. The ballast of claim 5 wherein the controlled reactance comprises a controlled inductor having at least one winding.

7. The ballast of claim 5 wherein the bi-directional active control device 21 comprises a switching device coupled to a diode network.

8. The ballast of claim 5 wherein the pulse modulator comprises a pulse width modulator.

* * * * *